US005945815A

United States Patent [19]

Elliott

[11] Patent Number: 5,945,815

[45] Date of Patent: Aug. 31, 1999

[54] CURRENT SHARING APPARATUS AND METHOD FOR CONTROLLING PARALLEL POWER DEVICES

[75] Inventor: Stephen H. Elliott, Bradenton, Fla.

[73] Assignee: Trilectron Industries, Inc., Miami, Fla.

[21] Appl. No.: 09/097,201

[22] Filed: Jun. 12, 1998

[51] Int. Cl.[6] ..... G05F 1/40

[52] U.S. Cl. ..... 323/269; 323/280; 307/57

[58] Field of Search ..... 307/55, 57, 60, 307/87; 323/269, 274, 280

[56] References Cited

U.S. PATENT DOCUMENTS

| | | | |
|---|---|---|---|
| 4,219,872 | 8/1980 | Engelmann | 363/126 |
| 4,355,341 | 10/1982 | Kaplan | 361/79 |
| 4,490,779 | 12/1984 | Minks | 363/48 |
| 4,598,351 | 7/1986 | Fair et al. | 363/49 |
| 4,621,313 | 11/1986 | Kiteley | 363/49 |
| 4,679,130 | 7/1987 | Moscovici | 363/17 |
| 4,779,060 | 10/1988 | Henden | 330/277 |
| 4,878,164 | 10/1989 | Colombo | 363/49 |
| 4,893,228 | 1/1990 | Orrick et al. | 363/89 |
| 5,157,269 | 10/1992 | Jordan et al. | 307/59 |
| 5,233,180 | 8/1993 | Tsuruta et al. | 210/208.1 |
| 5,414,340 | 5/1995 | Gannon | 323/266 |
| 5,453,678 | 9/1995 | Bertolini et al. | 323/282 |
| 5,550,461 | 8/1996 | Pouzoullic | 323/269 |
| 5,592,072 | 1/1997 | Brown | 323/268 |
| 5,600,322 | 2/1997 | Garavan | 341/172 |
| 5,619,126 | 4/1997 | Lang | 323/273 |
| 5,668,467 | 9/1997 | Pease | 323/315 |

*Primary Examiner*—Shawn Riley
*Attorney, Agent, or Firm*—Darby & Darby

[57] ABSTRACT

A current sharing apparatus for use in a power device system having a plurality of power devices disposed in parallel relationship. The power devices each include a programmable current source, a capacitive element coupled to the current source to generate a reference voltage, a power device configured to generate an output voltage following that of the reference voltage, and a slew rate controller. The controller has an input disposed in sensed communication with the output voltage to generate an error signal and control current from the current source. The current sharing apparatus includes a system output drawer connected to the respective power supply outputs to collect a total system output and a system output detector coupled to the system output drawer. The detector measures the total output through the drawer and is operative to generate a signal indicative of the total output and feed the signal to the respective slew rate controller inputs to further modify the error signals. The respective slew rate controllers are each independently operative to compare the system output to the corresponding power device outputs and, when the corresponding power device output is less than a predetermined fraction of the system output, to increase the corresponding power device output.

10 Claims, 2 Drawing Sheets

CURRENT SHARING APPARATUS AND METHOD FOR CONTROLLING PARALLEL POWER DEVICES

FIELD OF THE INVENTION

The invention relates to electronic DC power supplies and more particularly to an apparatus and method for controlling parallel power supplies with separate slew rate circuits.

BACKGROUND OF THE INVENTION

Regulated D.C. power supplies provide predictable and reliable voltage sources for driving electronic circuitry. The conventional power supply design typically employs a power device for developing a D.C. voltage output and a regulating feedback loop. The regulation loop serves to maintain the power supply output voltage at a pre-selected set point by sensing the output voltage and increasing or decreasing the output relative to the desired set point.

To dampen the response of the feedback loop, many power supply designs employ a slew rate limiting circuit. The circuit changes the supply output voltage from 0 volts to a preselected set point voltage relatively slowly, rather than instantaneously. As a result, the slew rate circuit tends to reduce the stress on any loads developed by the sudden application of power to a deenergized electronic circuit.

The dampening effect of the slew rate circuit also reduces any transient voltage overshoot associated with the power supply regulation loop. Overshoots often develop from the fast feedback response of the system that produces a high initial error at start-up, causing saturation of the control loop with a corresponding overshoot above the desired set point.

Individual power supplies often have power capabilities corresponding to the physical unit sizes. This is often due to the bulk created by cooling fans, heat sinks and other cooling systems typically required to protect high-power devices from over-heating. An alternative to employing these large, bulky units involves utilizing a plurality of relatively small, low-powered power supply units in parallel relationship. This configuration also provides redundancy in the power supply system for ensuring that a load receives a relatively uninterrupted supply of power.

For power supply systems utilizing a plurality of parallel power supplies, slew rate limiting for each unit becomes relatively complex. It is important to maintain separate slew rate control for the individual power supplies because of inconsistencies in electronic component values that make up each power supply. Moreover, it is desirable to have the capability of selectively bringing one or more power supplies off-line should a problem arise with respect to component overheating or the like.

Therefore, the need exists for a current sharing apparatus and method for use with a power supply system having the capabilities of separately controlling the respective power supply slew rates, and for selectively bringing one or more power supplies off-line without shutting down the entire power supply system. The apparatus and method of the present invention satisfies these needs.

SUMMARY OF THE INVENTION

The apparatus and method of the present invention provides a current sharing capability for a system of parallel power supplies that enables control of the individual power supplies through separate slew rate circuits. Moreover, the level of control implemented by the present invention minimizes undesirable "hunting" of the respective power supplies to arrive at a final operating point. Further, the invention allows for selectively taking a power supply off-line to effect repair or replacement of a unit without shutting down the entire system. These advantages give the present invention a wide flexibility in electronic D.C. power supply applications.

To realize the above advantages, in one form the invention comprises a current sharing apparatus for use in a power device system having a plurality of power devices disposed in parallel relationship. The power devices each include a programmable current source, a capacitive element coupled to the current source to generate a reference voltage, a power device configured to generate an output voltage following that of the reference voltage, and a slew rate controller. The controller has an input disposed in sensed communication with the output voltage to generate an error signal and control current from the current source. The current sharing apparatus includes a system output drawer connected to the respective power supply outputs to collect a total system output and a system output detector coupled to the system output drawer. The detector measures the total output through the drawer and is operative to generate a signal indicative of the total output and feed the signal to the respective slew rate controller inputs to further modify the error signals. The respective slew rate controllers are each independently operative to compare the system output to the corresponding power device outputs and, when the corresponding power device output is less than a predetermined fraction of the system output, to increase the corresponding power device output.

In another form, the invention comprises a method a method of sharing current between a plurality of power supplies disposed in parallel relationship. The power supplies each include a programmable current source, a capacitive element coupled to the current source, a power device connected to the capacitive element, and a slew rate controller. The method includes the steps of first generating respective power device outputs with the respective power supplies; collecting the respective outputs into a system output drawer; sampling the respective power device outputs with the respective slew rate controllers; detecting the system output through the current drawer; comparing the sampled power device outputs with the detected system output; and generating respective error signals for feeding back to the respective current sources, based on the comparison, when the respective power device outputs are respectively less than a predetermined fraction of the system output, to increase the corresponding power device output.

Other features and advantages of the present invention will be apparent from the following detailed description when read in conjunction with the accompanying drawings.

DETAILED DESCRIPTION OF THE INVENTION

Figure 1:
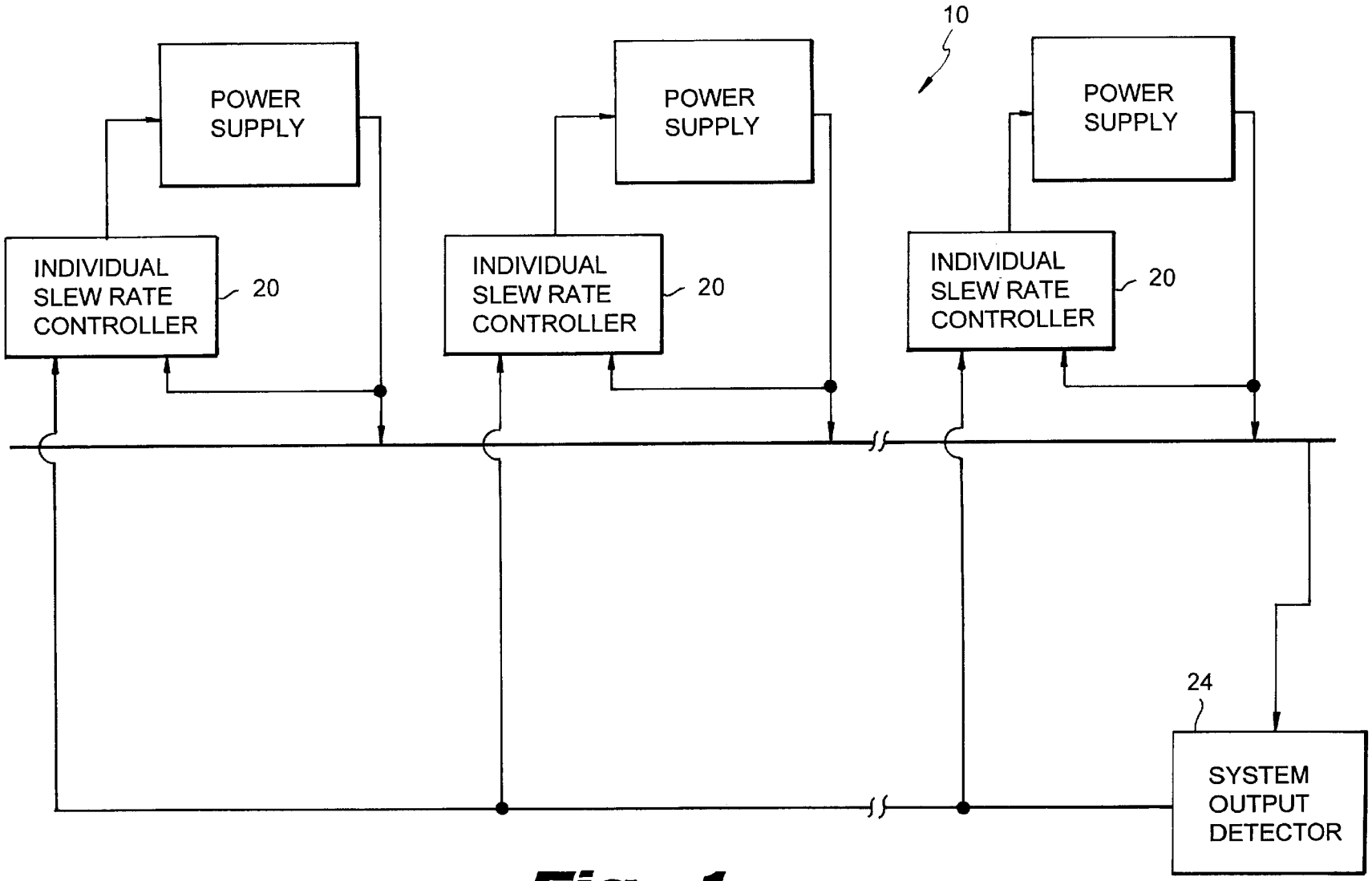
FIG. 1 is a block diagram of a power supply system incorporating a current sharing apparatus according to one embodiment of the present invention.

Referring now to FIG. 1, the current sharing apparatus of the present invention is employed in a power supply system, generally designated 10, to allow individual slew rate control of a plurality of power supplies PS with individual slew rate controllers 20 that are responsive to the outputs of the respective power supplies and the total system output as detected by a system output detector 24.

Figure 2:
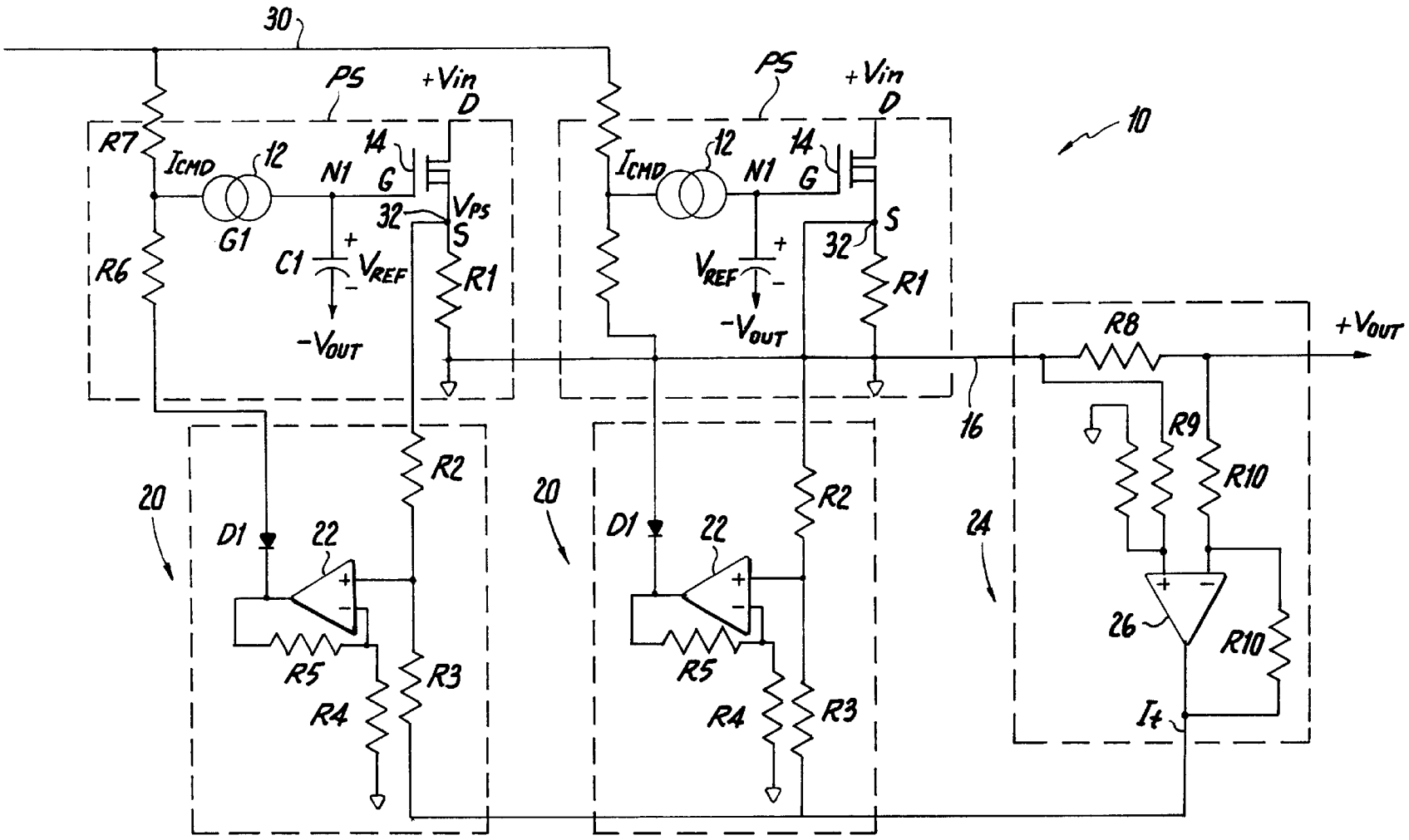
FIG. 2 is a component level block diagram schematic of the power supply system of FIG. 1.

Referring more particularly to FIG. 2, the respective power supplies PS (in phantom) include a programmable current source 12 for charging a capacitive element C1 to develop a reference voltage Vref. A power device 14 disposed in sensed communication with the reference voltage produces an output that follows the reference voltage. By programmably varying the current through the capacitive element, such as through feedback or the like, the power supply output can be predictably adjusted in a linear fashion.

Further referring to FIG. 2, the programmable current source 12 for each power supply comprises an operational amplifier (not shown) connected in the well-known "bi-polar current source for grounded load" configuration. The current source responds to a current command signal Icmd which may be generated from a current controller (not shown) and modified by the corresponding slew rate controller 20 as described below.

The capacitive element C1 comprises a reference capacitor and is tied to a reference node N1 which in turn is connected to the output of the programmable current source 12. Preferably, the current source generates current within the range of approximately +/−0.1 to 1.0 milliamps while the reference capacitor has a capacitance of approximately 0.1 to 1.0 microfarads. These component values produce slew rates of approximately 100 V/s to 10,000 V/s (0.1V/ms to 10V/ms). The opposite end of the capacitor is left floating to define the negative output voltage terminal −Vout for the power supply PS. The negative terminal may then be tied to a negative power supply bus (not shown) for accessibility by one or more loads.

With continued reference to FIG. 2, the power device 14 comprises a MOSFET transistor with its gate G connected to the reference node N1. The transistor is employed in a source-follower configuration with the source S providing a voltage output +Vout that closely follows the voltage generated at the node N1 by the capacitor. The drain D of the transistor is tied to a pre-regulated voltage source or pre-regulator (not shown) which supplies a regulated voltage Vin to power the MOSFET. The source S is connected to a sense resistor R1 and feeds current through R1 to a current drawer 16. The current drawer comprises a current bus that collects current from all of the power devices to define a total system current output.

Each slew rate controller 20 is positioned between the output of the power device and the input of the current source to sample the power device output, generate an error signal, and modify the current source current with the error signal. The controller includes a voltage divider network comprising a pair of resistors R2 and R3 to deliver an input voltage to an error amplifier 22. The input voltage to the error amplifier comprises the sum of a signal sampled from the respective voltage output of the individual power supply PS, and a signal representative of the overall system output current. The overall output current signal is generated by a current detector 24 and is proportional to the overall current through the current drawer 16. The resistors R2 and R3 are selected such that when the current through R1 is exactly a fraction 1/N of the total current generated by the plurality of power supplies PS, the voltage at the R2–R3 node is zero. The error amplifier 22 is coupled to resistors R4 and R5 in a negative feedback configuration to produce an inverted output signal proportional to the voltage divider input. A diode D1 is disposed between the output of the error amplifier and a second divider network including resistors R6 and R7.

The current detector 24 includes an operational amplifier 26 having respective input resistors R9 and R10 connected across the respective terminals of a current shunt R8 disposed in series with the current drawer 16. A resistor R10 connects the inverting terminal of the amplifier to the amplifier output to create negative feedback and to linearly control the amplifier output as a proportion of the total current through the shunt R8. The output of the detector amplifier 26 is fed in parallel to the respective input voltage divider networks for comparison by the respective error amplifiers 22 with the respective feedback signals from the outputs of the individual power supplies.

Prior to operation, the initially desired slew rate of the power supply system 10 is pre-set by establishing an initial voltage at 30 to cause command current flow Icmd through R7 and into the programmable source 12. The level of command current varies with respect to the input feedback current supplied through operation of the current sharing apparatus as described below.

During normal operation at start-up, each error amplifier 22 issues a maximum-positive control signal to the current source 12 due to the large difference between the individual power supply output current and the detected overall system current. In response, the current source drives current toward node N1. Because of the very high input impedance, virtually none of the current flows into the MOSFET gate G. Consequently, virtually all of the current flows through the reference capacitor C1. The injected current charges the capacitor at a linearly increasing voltage according to the well known equation:

$$V=1/C\int idt$$

The negative side of the capacitor provides the negative output potential −Vout for the power supply PS.

The power device 14, operating in a source-follower configuration, produces a positive output voltage at its source S. The power supply output voltage Vps is the difference between the reference voltage Vref and the nominal gate-source voltage Vgs. The output voltage Vps drops across resistor R1 to create an individual output current that collects in the current drawer 16. The output voltage Vps is sampled at 32 and fed to the error amplifier 22 through voltage divider network R2/R3.

Simultaneously, the current detector 24 monitors the total current generated by the power supplies PS and produces a total output current indicator It representative of the overall current. The current indicator It is summed at the inputs to the respective error amplifiers 22 with the individually sampled power supply output signals Vps. If the total output current indicator It is greater than N*(Vps), then the error amplifier output voltage will go negative, subject to the voltage drop from the diode D1. A negative input to the programmable current source 12 causes an increase in the current source output, raising the reference voltage Vref across the capacitor C1, and linearly increasing the output current and voltage Vps from the power device 14.

When the total output current indicator It approaches N*(Vps), the input to the error amplifier 22 becomes correspondingly small such that the diode D1 becomes reverse-biased. This effectively opens (disables) the control circuit so that the individual power supply operates at a final operating point. The band of shut-off voltages for the diode is conveniently relatively wide.

Those skilled in the art will appreciate the many benefits and advantages offered by the present invention. A significant advantage involves the current sharing capability for a system of parallel power supplies that enables control of the individual power supplies through separate slew rate circuits. Moreover, the level of control implemented by the present invention minimizes undesirable "hunting" of the respective power supplies to arrive at a final operating point. These advantages give the present invention a wide flexibility in electronic D.C. power supply applications.

While the invention has been particularly shown and described with reference to the preferred embodiments thereof, it will be understood by those skilled in the art that various changes in form and detail may be made therein without departing from the spirit and scope of the invention.

What is claimed is:

1. A current sharing apparatus for use in a power device system having a plurality of power devices disposed in parallel relationship, said power devices each including a programmable current source, a capacitive element coupled to said current source to generate a reference voltage, a power device configured to generate an output voltage following that of said reference voltage, and a slew rate controller having an input disposed in sensed communication with said output voltage to generate an error signal and control current from said current source, said current sharing apparatus including:

a system output drawer connected to the respective power supply outputs to collect a total system output; and a system output detector coupled to said system output drawer to measure the total output through said drawer, said detector operative to generate a signal indicative of said total output and having respective parallel connections to said respective slew rate controller inputs to further modify said error signals, whereby said respective slew rate controllers are each independently operative to compare said system output to said corresponding power device outputs and, when said corresponding power device output is less than a predetermined fraction of said system output, to increase said corresponding power device output.

2. A power supply according to claim 1 wherein:

said system output drawer comprises a current bus, and said total system output comprises current flow.

3. A power supply according to claim 2 wherein:

said system output detector comprises a current sensor.

4. A power device system including:

a system output drawer;

a plurality of power devices disposed in parallel relationship and having respective current outputs coupled to said system output drawer, said power devices each including a programmable current source, a capacitive element coupled to said current source to generate a reference voltage, a power device configured to generate an output voltage following that of said reference voltage, and a slew rate controller having an input disposed in sensed communication with said output voltage to generate an error signal and control current from said current source; and a system output detector coupled to said system output drawer to measure the total output through said drawer, said detector operative to generate a signal indicative of said total output and having respective parallel connections to said respective slew rate controller inputs to further modify said error signals, whereby said respective slew rate controllers are each independently operative to compare said system output to said corresponding power device outputs and, when said corresponding power device output is less than a predetermined fraction of said system output, to increase said corresponding power device output.

5. A power supply according to claim 4 wherein said programmable current source comprises:

an operational amplifier disposed in a bi-polar current source for grounded load configuration.

6. A power supply according to claim 4 wherein:

said capacitive element comprises a capacitor having respective positive and negative voltage terminals.

7. A power supply according to claim 6 wherein:

said output is referenced to said capacitor negative terminal.

8. A power supply according to claim 4 wherein:

said power device comprises a MOSFET.

9. A method of sharing current between a plurality of power supplies disposed in parallel relationship, said power supplies each including a programmable current source, a capacitive element coupled to said current source, a power device connected to said capacitive element, and a slew rate controller, said method including the steps of:

generating respective power device outputs with said respective power supplies;

collecting said respective outputs into a system output drawer;

sampling said respective power device outputs with said respective slew rate controllers;

detecting said system output;

comparing said sampled power device outputs with said detected system output; and generating respective error signals for feeding back to said respective current sources, based on said comparison, when said respective power device outputs are respectively less than a predetermined fraction of said system output, to increase the corresponding power device output.

10. A method according to claim 9 wherein said step of generating respective power supply outputs includes the steps of:

charging said capacitive element to generate a reference voltage;

sensing said reference voltage with said control element; and generating an output voltage at said power device output that follows said sensed reference voltage whereby changes in said charging adjust said reference voltage to correspondingly create a proportional change in said output voltage.

* * * * *